US006881275B2

(12) United States Patent
Eiermann et al.

(10) Patent No.: US 6,881,275 B2
(45) Date of Patent: Apr. 19, 2005

(54) METHOD FOR THE OPEN-LOOP AND CLOSED-LOOP CONTROL AND DOCUMENTATION OF A CLEANING OPERATION WITH A CLEANING MEDIUM

(75) Inventors: Rüdiger Eiermann, Syrgenstein (DE); Egbert Classen, Wertingen (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 113 days.

(21) Appl. No.: 10/073,555

(22) Filed: Feb. 11, 2002

(65) Prior Publication Data

US 2002/0108639 A1 Aug. 15, 2002

Related U.S. Application Data

(63) Continuation of application No. PCT/EP00/07647, filed on Aug. 7, 2000.

(30) Foreign Application Priority Data

Aug. 11, 1999 (DE) ..... 199 38 010

(51) Int. Cl.[7] ..... B08B 7/04

(52) U.S. Cl. ..... 134/18; 134/25.2; 134/26; 134/29; 134/57 D

(58) Field of Search ..... 134/18, 25.2, 25.1, 134/26, 29, 56 R, 57 R, 57 D, 58 R, 58 D

(56) References Cited

U.S. PATENT DOCUMENTS

| | | | | |
|---|---|---|---|---|
| 3,669,891 A | * | 6/1972 | Greenwood et al. | 424/10.1 |
| 4,783,314 A | * | 11/1988 | Hoots et al. | 422/3 |
| 5,370,743 A | * | 12/1994 | Usui et al. | 134/18 |
| 5,536,663 A | * | 7/1996 | Mueller-Kirschbaum et al. | 436/55 |

FOREIGN PATENT DOCUMENTS

| | | |
|---|---|---|
| DE | 42 04 806 A1 | 8/1993 |
| DE | 44 15 823 A1 | 11/1995 |
| DE | 197 05 926 A1 | 8/1998 |
| GB | 0 362 435 A1 | 4/1990 |
| WO | WO 93/16225 | 8/1993 |
| WO | WO 95/12704 | 5/1995 |

* cited by examiner

*Primary Examiner*—Alexander Markoff
(74) *Attorney, Agent, or Firm*—Laurence A. Greenberg; Werner H. Stemer; Gregory L. Mayback

(57) ABSTRACT

A method for the open-loop and closed-loop control and documentation of a cleaning operation with a cleaning medium includes the steps of adding at least one indicator to the cleaning medium, setting parameters for at least one partial step in the cleaning operation by comparative measurements of the concentration of the at least one indicator in the mixture including cleaning medium, possibly with detergent and at least one indicator, and documenting at least the parameter settings. The method makes possible an exact result and exact setting of parameters for at least one partial step in the cleaning operation.

21 Claims, No Drawings

METHOD FOR THE OPEN-LOOP AND CLOSED-LOOP CONTROL AND DOCUMENTATION OF A CLEANING OPERATION WITH A CLEANING MEDIUM

CROSS-REFERENCE TO RELATED APPLICATION

This application is a continuation of copending International Application No. PCT/EP00/07647, filed Aug. 7, 2000, which designated the United States.

BACKGROUND OF THE INVENTION

Field of the Invention

The invention relates to a method for the open-loop and closed-loop control and documentation of a cleaning operation with a cleaning medium, using at least one indicator added to the cleaning medium.

For household dishwashing machines, German Published, Non-Prosecuted Patent Application DE 44 15 823 A discloses a method in which, by indicators added to a cleaning liquid, a significant color change in the cleaning liquid is caused when specific types of contamination occur, and the change is detected by sensors, for example, biosensors, photometric sensors, or sensors transmitting and receiving ultrasound, and whose intensity is measured.

The addition of indicator needed for various types of contamination leads to repeated coloration of the cleaning liquid, so that in the method according to German Published, Non-Prosecuted Patent Application DE 44 15 823 A, it is ultimately no longer possible for the complete range of types of contaminants that can be detected and their intensity to be determined exactly.

SUMMARY OF THE INVENTION

It is accordingly an object of the invention to provide a method for the open-loop and closed-loop control and documentation of a cleaning operation with a cleaning medium that overcomes the hereinafore-mentioned disadvantages of the heretofore-known devices and methods of this general type and that uses at least one indicator added to the cleaning medium in which an exact result and exact setting of parameters for at least one partial step in the cleaning operation are made possible.

With the foregoing and other objects in view, there is provided, in accordance with the invention, method for the open-loop and closed-loop control and documentation of a cleaning operation with a cleaning medium including the steps of adding at least one indicator to the cleaning medium, setting parameters for at least one partial step in the cleaning operation by comparative measurements of a concentration of the at least one indicator in a mixture including the cleaning medium, and documenting at least the parameter settings.

The measurement of the concentration of the indicator in the mixture including cleaning medium, possibly with detergent and at least one indicator, is an exact measurement, fitting the task, with which exact setting of parameters for at least one partial step in the subsequent cleaning operation is possible. As a result of the repeated measurement and setting of parameters, simple open-loop control of the cleaning operation is possible. By the documentation of the individual results, further influence on the setting of parameters and, therefore, still more exact open-loop control of the cleaning operation is possible. Therefore, the invention provides, in a simple way, a method for the open-loop and closed-loop control and documentation of a cleaning operation with a cleaning medium, using at least one indicator added to the cleaning medium. In the method, an exact result and exact setting of parameters for at least one partial step in the cleaning operation is made possible.

In accordance with another mode of the invention, by the comparative measurements of the concentration of the at least one indicator in the mixture, possibly with detergent and at least one indicator, parameters are set for the partial step already running and/or at least one following partial step in the cleaning operation. The fact that even the partial step currently running in the cleaning operation is also influenced ensures the complete open-loop and closed-loop control and documentation of the complete cleaning operation.

In accordance with a further mode of the invention, the universal application of the method according to the invention is ensured in that the cleaning medium can be present in solid and/or liquid and/or gaseous form and/or mixtures of these forms.

In accordance with an added mode of the invention, the complete open-loop and closed-loop control and documentation of the complete cleaning operation is further ensured in that the measurements of the concentration of the at least one indicator in the mixture including cleaning medium, possibly with detergent and at least one indicator, and/or of the quantity of the mixture of cleaning medium present, possibly with detergent and at least one indicator, are carried out during the progress of a partial step in the cleaning operation.

In accordance with yet another mode of the invention, after the at least one indicator has been added, a measurement is made of the concentration of the at least one indicator in the mixture, possibly with detergent and at least one indicator and, after the cleaning medium has been applied to goods to be cleaned, at least one further measurement is made of the concentration of the at least one indicator in the mixture and/or at least one measurement is made of the quantity of mixture present and, from the comparison of the measurements, the quantity of the at least one indicator removed from the mixture is determined and, based upon the determined quantity of the at least one indicator removed from the mixture, parameters are set for the partial step already running and/or at least one following partial step in the cleaning operation. It is possible for at least the parameter settings to be documented. As a result of the comparative measurement before and after the cleaning medium has been applied to goods to be cleaned, the required exact measurement, fitting the task, is made possible in a simple way, as a result of which the required exact influence on the cleaning operation, fitting the task, is also made possible in a simple way. As a result of the measurement and setting of parameters, repeated only once, still simpler open-loop control of the cleaning operation is possible. By the documentation of the individual results, further influence on the setting of parameters and, therefore, still more exact open-loop control of the cleaning operation is possible.

In accordance with yet a further mode of the invention, further simplification of the method according to the invention is achieved in that the further measurement of the concentration of the at least one indicator in the mixture and/or the quantity of the mixture of cleaning medium present is performed during an emptying operation of the mixture.

In a particularly advantageous way, in accordance with yet an added mode of the invention, the parameters defined for at least one partial step in the cleaning operation are the temperature and/or the quantity of cleaning medium and/or the at least one time and the at least one quantity of the addition of additives to the cleaning medium and/or the duration and/or the intensity of the application of the its cleaning medium to goods to be cleaned, which covers the significant parameters of a cleaning operation with cleaning medium.

In accordance with a concomitant mode of the invention, the documentation of at least the parameter settings is performed in storage media belonging to a control device for the cleaning operation. Such action achieves the further simplification of the method according to the invention because a component present in any case for the open-loop control of a cleaning operation can additionally be used.

Other features that are considered as characteristic for the invention are set forth in the appended claims.

Although the invention is illustrated and described herein as embodied in a method for the open-loop and closed-loop control and documentation of a cleaning operation with a cleaning medium, it is, nevertheless, not intended to be limited to the details described because various modifications and structural changes may be made therein without departing from the spirit of the invention and within the scope and range of equivalents of the claims.

The construction and method of operation of the invention, however, together with additional objects and advantages thereof, will be best understood from the description of specific embodiments.

DESCRIPTION OF THE PREFERRED EMBODIMENTS

The invention will be explained below using the exemplary embodiment of a household dishwashing machine. In a non-illustrated household dishwashing machine, the cleaning operation—the dishwashing program—is carried out with a cleaning medium—the dishwashing solution—present in liquid form. The complete dishwashing program runs in partial steps—namely, as is usual, in five partial program steps. These steps include the partial program step "prewash", the partial program step "clean", the partial program step "intermediate rinse", the partial program step "final rinse", and the partial program step "dry". In the household dishwashing machine, the method according to the invention for the open-loop and closed-loop control and documentation of a cleaning operation with a cleaning medium is applied as follows in a simplified embodiment.

During the partial program step "prewash", an indicator is added to the exact quantity of dishwashing solution put in for each type of contamination. It is possible for the indicator to be added to the dishwashing solution as powder or as liquid and to be dissolved in the dishwashing solution. Following, a measurement of the concentration of the indicator or the indicators in the solution including dishwashing solution and indicators is taken. Next, the dishwashing solution is applied to the goods to be cleaned during the defined duration of the partial program step "prewash" by recirculating the dishwashing solution and spraying it upon the goods to be cleaned. During such application of the dishwashing solution to the goods to be cleaned, the corresponding indicator is taken up by corresponding types of contamination or is deposited on the contamination, so that the concentration of the indicator or the indicators in the solution including dishwashing solution and indicators is reduced in an exactly measurable way.

According to the invention, the measurements of the concentration of the at least one indicator in the mixture including cleaning medium, possibly with detergent and at least one indicator, and/or of the quantity of the mixture of cleaning medium present, possibly with detergent and at least one indicator, is carried out during the progress of a partial step in the cleaning operation. The reduction in the concentration of the indicator or the indicators in the in solution including dishwashing solution and indicators in the household dishwashing machine is carried out only at the end of the partial program step "prewash". That is, it is performed during the emptying operation of the solution from the household dishwashing machine by measuring the quantity of solution of dishwashing solution and indicators present, and a further measurement of the concentration of the indicator or the indicators in the solution including dishwashing solution and indicators. From the comparison of such measurements, the quantity of the indicators removed from the solution including dishwashing solution and indicators, that is to say, taken up by the various types of contamination or deposited on the contamination, can be determined. Based upon the determined quantity of indicator or indicators removed from the solution including dishwashing solution and indicators, parameters are set for the following partial program step "clean" in the dishwashing program.

By the comparative measurements of the concentration of the at least one indicator in the mixture including cleaning medium, possibly with detergent and at least one indicator, according to the invention parameters are set for the partial program step already running and/or at least one following partial program step in the cleaning operation. In the household dishwashing machine according to the exemplary embodiment, the parameters set for the following partial program steps are the temperature and the quantity of the dishwashing solution and the time and the quantity of the addition of additives to the dishwashing solution and the duration and intensity of the application of the dishwashing solution to the goods to be cleaned.

The measuring operations described in the partial program step "prewash" are then repeated in the partial program steps that use the dishwashing solution—"clean", "intermediate rinse", and "final rinse". Thus, a completely automatic dishwashing program adapted to the types and quantities of the individual contaminants is defined and carried out. In the method described, the parameter settings are documented in storage media of a control device for the dishwashing program to permit further influence on the setting of parameters and, therefore, still more exact open-loop control of the dishwashing program.

By using the simplified method according to the invention described for the household dishwashing machine, therefore, according to the invention, by comparative measurements of the concentration of the at least one indicator in the mixture including cleaning medium, possibly with detergent and at least one indicator, parameters are set for at least one partial step in the cleaning operation, it being possible for at least the parameter settings to be documented. The measurement of the concentration of the indicator in the mixture including cleaning medium, possibly with detergent and at least one indicator, is an exact measurement, fitting the task, with which exact setting of parameters for at least one partial step in the cleaning operation is possible. By the repeated measurement and setting of parameters, simple open-loop control of the cleaning operation is possible. As a result of the documentation of the individual results, further influence on the setting of parameters and, therefore, still more exact open-loop control of the cleaning operation is possible. Therefore, the invention provides, in a simple way, a method for the open-loop and closed-loop control and documentation of a cleaning operation with a cleaning medium, using at least one indicator added to the cleaning medium, in which an exact result and exact setting of parameters for at least one partial step in the cleaning operation are made possible.

We claim:

1. A method for the open-loop and closed-loop control and documentation of a cleaning operation with a cleaning medium in a household dishwasher, which comprises:

adding at least one indicator to a quantity of the cleaning medium during a prewash step to create a mixture and measuring a concentration of the at least one indicator in the mixture;

setting parameters for at least one partial step in the cleaning operation by comparative measurements of a concentration of the at least one indicator in the mixture;

documenting at least the parameter settings; and controlling the setting parameters for the at least one partial step of the cleaning operation based upon the documented parameter settings.

2. The method according to claim 1, wherein the mixture includes at least one of the group consisting of detergent and the at least one indicator.

3. The method according to claim 1, which further comprises setting parameters for at least one of the group consisting of a partial step already running in the cleaning operation and at least one following partial step in the cleaning operation by comparative measurements of the concentration of the at least one indicator in the mixture.

4. The method according to claim 1, wherein the cleaning medium includes a detergent in a form selected from at least one of the group consisting of:

a solid form;

a liquid form; and a mixture of a solid form and a liquid form.

5. The method according to claim 1, which further comprises carrying out the measurements of at least one of the group consisting of:

the concentration of the at least one indicator in the mixture; and a quantity of cleaning medium present in the mixture, during a progress of a partial step in the cleaning operation.

6. The method according to claim 5, wherein the mixture includes at least one of the group consisting of detergent and the at least one indicator.

7. The method according to claim 1, which further comprises:

after the at least one indicator has been added, measuring the concentration of the at least one indicator in the mixture;

applying the mixture including the cleaning medium to goods; after the cleaning medium has been applied to the goods to be cleaned, performing at least one of the group consisting of:

a further measurement of the concentration of the at least one indicator in the mixture; and a measurement of the quantity of the mixture present;

determining a quantity of the at least one indicator removed from the mixture from a comparison of the measurements; and based upon the determined quantity of the at least one indicator removed from the mixture, setting parameters for one of the group consisting of:

a partial step already running in the cleaning operation; and at least one following partial step in the cleaning operation.

8. The method according to claim 7, wherein the mixture includes at least one of the group consisting of detergent and the at least one indicator.

9. The method according to claim 7, which further comprises performing at least one of the group consisting of:

the further measurement of the concentration of the at least one indicator in the mixture; and the measurement of the quantity of the mixture present, during a mixture emptying operation.

10. The method according to claim 1, wherein the parameters defined for the at least one partial step in the cleaning operation include at least one of the group consisting of:

a temperature of the cleaning medium;

a quantity of the cleaning medium;

at least one time of an addition of additives to the cleaning medium;

at least one quantity of the addition of additives to the cleaning medium;

a duration of an application of the cleaning medium to goods to be cleaned; and an intensity of the application of the cleaning medium to goods to be cleaned.

11. The method according to claim 1, which further comprises carrying out the documentation step by documenting at least the parameter settings in a storage media belonging to a control device of the dishwasher for the cleaning operation.

12. The method according to claim 1, which further comprises carrying out the controlling step by controlling the cleaning operation in one of the group consisting of an open-loop and a closed-loop.

13. A method for the control, regulation, and documentation of a cleaning operation with a cleaning medium in a household dishwasher, which comprises:

adding at least one indicator to a quantity of the cleaning medium during a prewash step to create a mixture and measuring a concentration of the at least one indicator in the mixture;

setting parameters for at least one partial step in the cleaning operation by comparative measurements of a concentration of the at least one indicator in the mixture;

documenting at least the parameter settings; and controlling the setting parameters for the at least one partial step of the cleaning operation based upon the documented parameter settings.

14. The method according to claim 13, wherein the mixture includes at least one of the group consisting of detergent and the at least one indicator.

15. The method according to claim 13, which further comprises setting parameters for at least one of the group consisting of a partial step already running in the cleaning operation and at least one following partial step in the cleaning operation by comparative measurements of the concentration of the at least one indicator in the mixture.

16. The method according to claim 13, wherein the cleaning medium includes a detergent in a form selected from at least one of the group consisting of:

a solid form;

a liquid form;

a mixture of a solid form and a liquid form.

17. The method according to claim 13, which further comprises carrying out the measurements of at least one of the group consisting of:

the concentration of the at least one indicator in the mixture; and a quantity of cleaning medium present in the mixture, during a progress of a partial step in the cleaning operation.

18. The method according to claim 13, which further comprises:

after the at least one indicator has been added, measuring the concentration of the at least one indicator in the mixture;

applying the mixture including the cleaning medium to items;

after the cleaning medium has been applied to the items to be cleaned, performing at least one of the group consisting of:

a further measurement of the concentration of the at least one indicator in the mixture; and a measurement of the quantity of the mixture present;

determining a quantity of the at least one indicator removed from the mixture from a comparison of the measurements; and based upon the determined quantity of the at least one indicator removed from the mixture, setting parameters for one of the group consisting of:

a partial step already running in the cleaning operation; and at least one following partial step in the cleaning operation.

19. The method according to claim 18, which further comprises performing at least one of the group consisting of:

the further measurement of the concentration of the at least one indicator in the mixture; and the measurement of the quantity of the mixture present, during a mixture emptying operation.

20. The method according to claim 13, wherein the parameters defined for the at least one partial step in the cleaning operation include at least one of the group consisting of:

a temperature of the cleaning medium;

a quantity of the cleaning medium;

at least one time of an addition of additives to the cleaning medium;

at least one quantity of the addition of additives to the cleaning medium;

a duration of an application of the cleaning medium to items to be cleaned; and an intensity of the application of the cleaning medium to the items to be cleaned.

21. The method according to claim 13, which further comprises carrying out the documentation step by documenting at least the parameter settings in a storage media belonging to a control device of the dishwasher for the cleaning operation.

* * * * *